US005350037A

United States Patent [19]

Ghahremani

[11] Patent Number: 5,350,037

[45] Date of Patent: Sep. 27, 1994

[54] WORKPERSON SAFETY RESTRAINT SYSTEM

[75] Inventor: Ali Ghahremani, Granada Hills, Calif.

[73] Assignee: Skymaster, Inc., City of Industry, Calif.

[21] Appl. No.: 65,478

[22] Filed: May 24, 1993

[51] Int. Cl.[5] ..... A62B 37/00

[52] U.S. Cl. ..... 182/3; 182/36

[58] Field of Search ..... 182/3–7, 182/36, 45, 12

[56] References Cited

U.S. PATENT DOCUMENTS

| | | | |
|---|---|---|---|
| 1,899,162 | 2/1933 | Lackner | 182/34 |
| 4,037,824 | 7/1977 | Whitmer | 182/3 |
| 4,699,245 | 10/1987 | Benedet | 182/36 |
| 4,721,182 | 1/1988 | Brinkmann et al. | 182/3 |
| 4,790,410 | 12/1988 | Sharp et al. | 182/36 |
| 5,002,152 | 3/1991 | Lebow | 182/3 |
| 5,224,427 | 7/1993 | Riches et al. | 248/548 X |

*Primary Examiner*—Alvin C. Chin-Shue
*Attorney, Agent, or Firm*—Boniard I. Brown

[57] ABSTRACT

A safety restraint system for a worker on an elevated structure has an elongated cable extending between cable supports spaced apart along the structure. The worker has a lanyard or line attached to a connector encircling the cable, whereby the worker can move along the support or ledge while restrained against falling. The connector includes a ring element with a radial slot wider than the transverse thickness of a support plate at each cable support to enable the ring element to pass through the cable support without being disconnected from cable. The slot is narrower than the cable thickness so that it is impossible for the worker to pull the ring element to draw the slot over the cable. Each ring element is slidably movable along the cable system to remove the ring from the cable system, and retractable stop means are provided at the endmost cable support to prevent inadvertent removal of a ring element from the cable system.

11 Claims, 2 Drawing Sheets

WORKPERSON SAFETY RESTRAINT SYSTEM

BACKGROUND OF THE INVENTION

1 Field of the Invention

The present invention relates to a safety restraint system for workpersons on elevated ledges, e.g., on high rise buildings. The system comprises a safety cable extending between spaced cable supports along the elevated work space, and a lanyard slidably connected to the cable. The lanyard is attached to the worker to enable the worker safely to move along the elevated work space without danger of falling.

2. Prior Developments

The present invention addresses the safety problems of workers working on narrow ledges and the like, typically on high rise buildings. Such workers typically engage in such tasks as window washing, caulking, etc.

Conventionally, the safety restraint system comprises a wire rope or cable secured to posts or stanchions at spaced points along the length of a ledge or work space. Typically, the posts are spaced apart about seven to ten feet. Each worker has one or two lanyards (short-flexible safety lines) attached to his belt or body harness. The other free end of each lanyard has a snap hook adapted to fit onto the cable so as to be slidable along the cable to prevent the worker from falling while at the same time enabling the worker to walk back and forth along the elevated work surface, typically a ledge on the side of a high rise building.

When only one lanyard is used, the worker must detach the snap hook from the cable in order to transit, the hook across each cable support post. If two lanyards are used, the worker can maintain one lanyard attached to the cable while disconnecting the other lanyard from the cable and reattaching it thereto on the other side of the post. When only one lanyard is used, substantial hazard is involved in the transitioning of a lanyard hook across each cable support. When two lanyards are used, there is a potential danger if a worker inadvertently disconnects both lanyards, rather than disconnecting and reconnecting the lanyard hooks in proper order.

The problem of safely transiting lanyard hook across a cable support has been addressed in several patents. In some cases the solution has been to modify the cable support to have a separable connection with the cable. The hook or ring structure on the lanyard can then be slid along the cable by temporarily deflecting the cable away from the cable support. This solution is not, entirely satisfactory in that the cable is not rigidly supported, and can sway or float vertically to some extent.

In one prior device, the lanyard connector was constructed with a helical slot extending therealong, such that the connector can be passed across the cable support by simultaneously rotating and sliding the connector so that the slot passes over the post.

The devices of the patents discussed below are believed to be representative of the art.

U.S. Pat. No. 4,037,824 to Whitmer discloses a safety device wherein an elongated safety line cable passes through two arcuate horns spaced a slight distance apart at the upper end of a support post. A lanyard or fitting controlled by the workman fits about the cable and can be passed across the two arcuate horns without detaching the lanyard from the cable by rotating the lanyard back and forth about the cable axis in a helical motion about the two horns. One problem is that the two arcuate horns do not directly contact the cable, and the cable can swing or sway transversely, because it is not rigidly supported from the arcuate horns. The horns merely limit the swaying motion without preventing such motion.

U.S. Pat. No. 4,699,245 to R. Benedet discloses a workman safety device wherein a horizontal cable extends through a confined space between a vertical C-shaped yoke and a rotatable disk. A workman's harness has an attachment ring that encircles the cable. The ring is movable along the cable and into a notch in the edge of the disk. Continued movement of the ring along the cable causes the disk to rotate about the disk axis located below the cable. The ring can thus be moved within the notch and along the cable through the space circumscribed by the disk. One problem with the system is that the cable must be lifted from its normal position in order to accommodate arcuate motion of the notch in the disk. Depending on the weight and tension on the cable, some manual pulling effort is required. Another disadvantage is that the cable is not rigidly connected to the disk or to the C-shaped yoke, the cable merely passing through the yoke-disk space, so that the cable can sway to some extent.

U.S. Pat. No. 4,790,410 to Sharp, et al., discloses a safety apparatus that includes a safety cable extending through a tubular head carried by a fixed support arm. The workman's harness or line is connected to an arcuate yoke element that partially encircles an elongated tube. The elongated tube has a helical slot extending along its entire length so that when the tube is passed along the cable and over the tubular head, the helical slot will have a cam action on the fixed support arm, thereby rotating the elongated tube around its axis. The tube is rotatably mounted in the arcuate yoke element to be rotatable without necessarily causing the yoke element to rotate. However, the slotted tube is relatively long in order to achieve only limited small slot angulation. The cam action between the slot and the fixed arm occurs at points remote or offset From the arcuate yoke element, so that in practice some binding can occur between the slotted tube and the yoke element, thereby adding to operational difficulty. Also, over time the yoke surface will frictionally wear and possibly cause the yoke element to separate from the slotted tube.

U.S. Pat. No. 5,105,907 to Lebow shows essentially the same construction and operational mode as the Whitmer patent. However, in the Lebow arrangement the C-shaped cable guide elements are spaced relatively far apart, and a notched cable-support plate is located between the two C-shaped guide elements.

U.S. Pat. No. 4,721,182 to Brinkman, et al., shows an overhead guide rail suspended near the roof of an underground sewer duct. A travelling connector at the end of a lanyard encircles the rail to prevent a workman from being swept along the duct. The travelling connector has an openable gate or hook for operation by the workman to permit passage of the connector past a guide rail support member. During the period when the gate (hook) is in an opened condition, the workman must physically support the weight of the overhead connector.

SUMMARY OF THE INVENTION

The present invention relates to a worker safety restraint system in which a cable is rigidly attached to spaced cable supports. Each cable support preferably comprises a flat upstanding plate having a horizontal length of about three inches and a thickness of about one quarter inch. The plate is arranged with its length dimension paralleling the cable axis and its thickness dimension extending transversely of the cable axis. The cable preferably has a diameter of about five-eighths inch, so the thickness of the plate is less than the diameter of the cable.

The lanyard has cable connector means including a ring element having a radial slot of a width slightly greater than the thickness dimension of the steel plate of each cable support. With this arrangement, the lanyard connector means can be slid along the cable and across the cable supports, because the slot in the ring element can pass over or across the plate. The narrow width dimension of the slot prevents the connector means from being detached from the cable.

In a preferred form of the invention, the ring element is connected to the lanyard by a tie element pivotable relative to the ring element and the lanyard. The tie element has an ear normally extending across the slot in the ring element when the lanyard is in a stressed condition. With the arrangement, in order for the worker to transit the ring element across a cable support, he must have the lanyard in a slack, non-tensioned condition. The practical effect is that he must move his body close to the cable support and extend his hands about the ring element and tie element in order to pass the ring element across the cable support. The effort required in this process tends to minimize the potential for slippage that otherwise exists if the worker were to attempt to pull the lanyard over the cable support while standing erect and possibly snagging the ring element on the cable support.

DESCRIPTION OF A PREFERRED EMBODIMENT OF THE INVENTION

Figure 1:
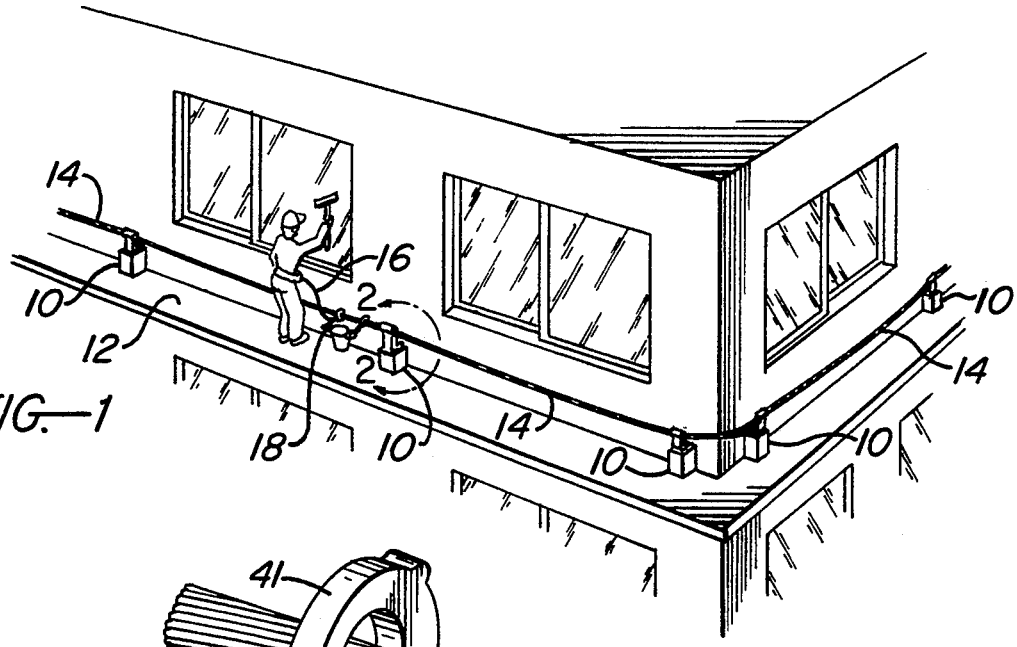
FIG. 1 is a perspective view of a portion high rise building with a safety restraint system of the present invention in use.

The safety restraint system shown in FIG. 1 comprises a plurality of spaced cable supports 10 disposed along a ledge 12 on a high rise building. A continuous wire cable 14 extends between and through the cable supports to provide a safety cable or rail for a worker, who has a flexible lanyard or line 16 attached to his belt. The free end of the lanyard is attached to a connector 18 encircling the cable, whereby the worker is prevented from falling off the elevated ledge. Connector 18 is adapted for sliding motion across the cable supports 10 so that the worker can move along the entire length of the elevated ledge.

Each cable support comprises an upright square tube 20 having a flat plate 21 welded to its upper end. An angle iron 23 is bolted to plate 21 to form a mount for a horizontal tube 25, which is clamped or otherwise rigidly secured to the multi-strand cable 14. Angle iron 23 has an upstanding vertical plate 27 whose upper edge is welded to the side surface of tube 25. The major plane of plate 27 is coincident with the axis of the cable.

Plate 27 will typically have a thickness dimension 29 of about one-fourth inch and a horizontal length 31 of about three inches. Length dimension 31 gives the plate the strength adequately to support or anchor cable 14.

Figure 2:
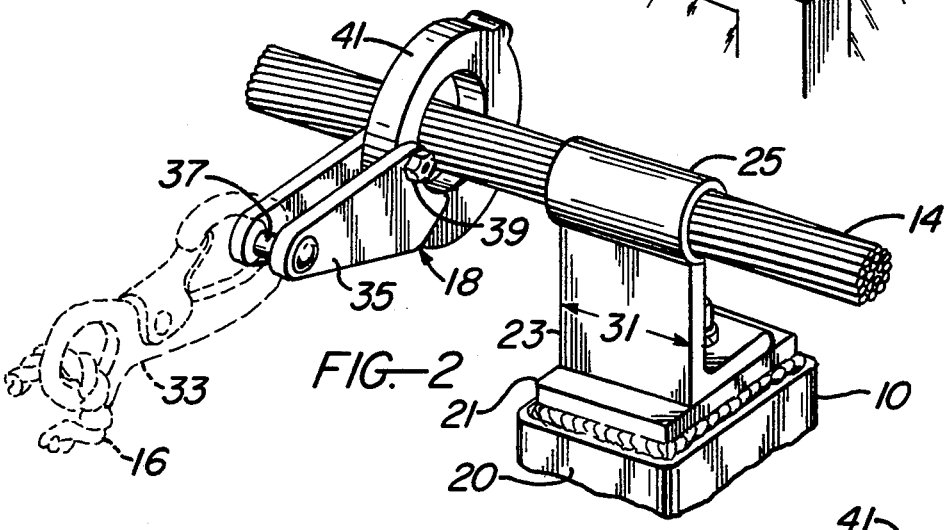
FIG. 2 is an enlarged perspective view of the area encircled by arrows 2—2 in FIG. 1.

The free end of lanyard 16 comprises a snap hook 33 (FIGS. 2 and 3) adapted for releasable attachment to one end of a tie element 35. The tie element is preferably a bifurcated structure comprising two spaced parallel plate elements connected by two pins 37 and 39. Pin 37 provides an attachment surface for snap hook 33. Pin 39 provides a pivotal connection between the tie element and a ring element 41.

Ring element 41 and tie element 35 together form connector means between lanyard 16 and cable 14. Ring element 41 has a central circular opening, whereby the ring element is slidable along the length of cable 14.

Figure 4:
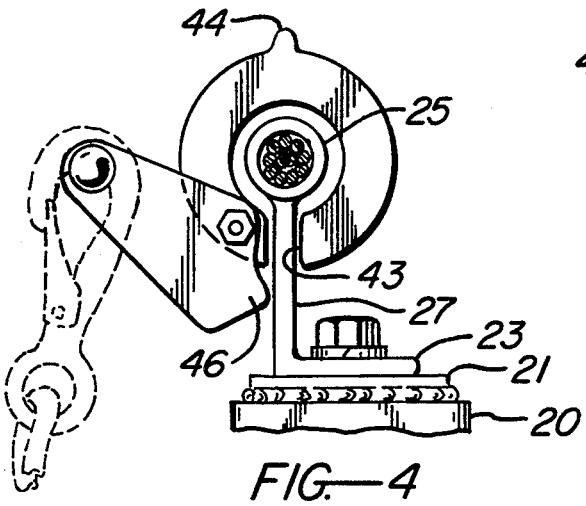
FIG. 4 is a view taken in the direction of FIG. 3, but showing the lanyard in a slack, non-tensioned condition.

Ring element 41 has a radial slot 43 of a width that is slightly greater than the width dimension 29 of each steel plate 27, whereby the ring element can be passed across plate 27 by orienting slot 43 so that it is in longitudinal registration with the plate (FIG. 4). The width of slot 43 is substantially less than the diameter of cable 14; and the diameter of cable 14 is typically about five-eights inch, whereas the width dimension of slot 43 is only about five-sixteenths inch. Ring element 41 cannot be removed From the cable via the slot.

Figure 3:
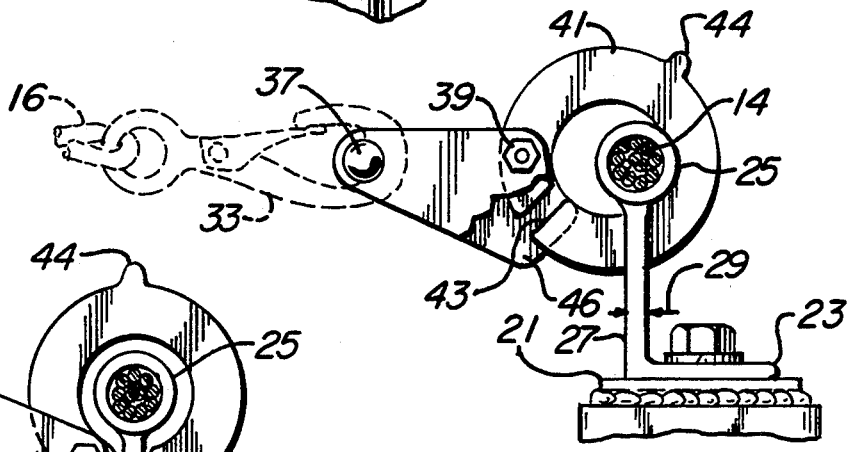
FIG. 3 is a view of the FIG. 2 structure taken along the axis of a safety cable.

Slot 43 is so oriented in ring element 41 that when the worker exerts a pulling force on lanyard 16 the slot is of offset from the plane of plate 27 (FIG. 3). As shown, the tie element pivot 39 is located on an imaginary line extending from the cable axis coincident with the lanyard line of action. Because slot 43 is offset from the plane of plate 27 (FIG. 3), the connector means cannot be passed through plate 27 when the lanyard is in a stressed (pulled) condition.

The lanyard 16 is required to be in a slack condition before ring element 41 can be passed across cable support 27, thus to ensure that the worker will move his body into close proximity with cable support 10 while making the transition of ring element 41 across the cable support. The worker must use at least one hand to rotate ring element so that slot 43 is longitudinally aligned with the edge of plate 27. A protrusion 44 on ring element provides a visual reference of the slot location. When the slot is oriented with plate 27, protrusion 44 is positioned directly above the cable 14 axis.

Tie element 35 provides a closure means to block slot 43 from entry onto plate 27. As shown in FIGS. 3 and 4, the closure means comprises ears or extensions 46 of the tie element plates, the extensions being offset downwardly from pivot 39 so that the tie element must be lifted slightly about pivot 39 to accomplish entry of slot 43 onto the edge of plate 27. Pivot 39 is located relatively close to slot 43, whereby only a slight lifting motion of the tie element about pivot 39 is required to open the closure means. Tie element 35 serves as a closure to ensure that a particular manipulation of ring element 41 and tie element 35 is required to accomplish a transition of the connector means across the cable support. The worker is required to position his body near the cable support in order to effect the transition.

Figure 7:
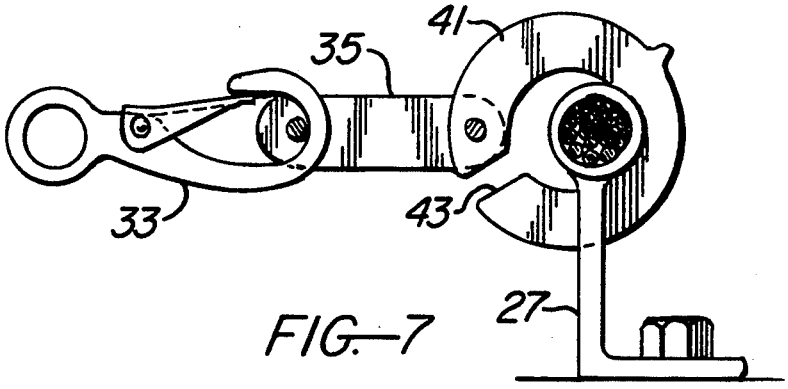
FIG. 7 is a view taken in the direction of FIG. 3, illustrating another embodiment of the invention.

FIG. 7 shows an alternate arrangement wherein the tie element has no ear-like extensions 46. The FIG. 7 construction operates in generally the same manner as the arrangement of FIGS. 1 through 4, except that the tie element does not have to be manipulated in order to effect entry of slot 43 onto cable support plate 27. In most respects, the structure of FIG. 7 is similar to the structure of FIGS. 1 through 4.

As hereinbefore mentioned, ring element 41 cannot be separated from cable 14 by movement of slot 43 transversely against cable 14. In order to effect removal of the ring element 41 from cable 14 (or to add new ring elements 41 to the cable system), it is necessary to slide the ring element along the cable until the ring element has been passed across an endmost one of the cable supports. However, it is not desired that passage of the ring element 41 across the endmost cable support be easily accomplished, because it would then be possible for a worker to inadvertently slip his ring element 41 off the cable during normal work operations.

Figure 5:
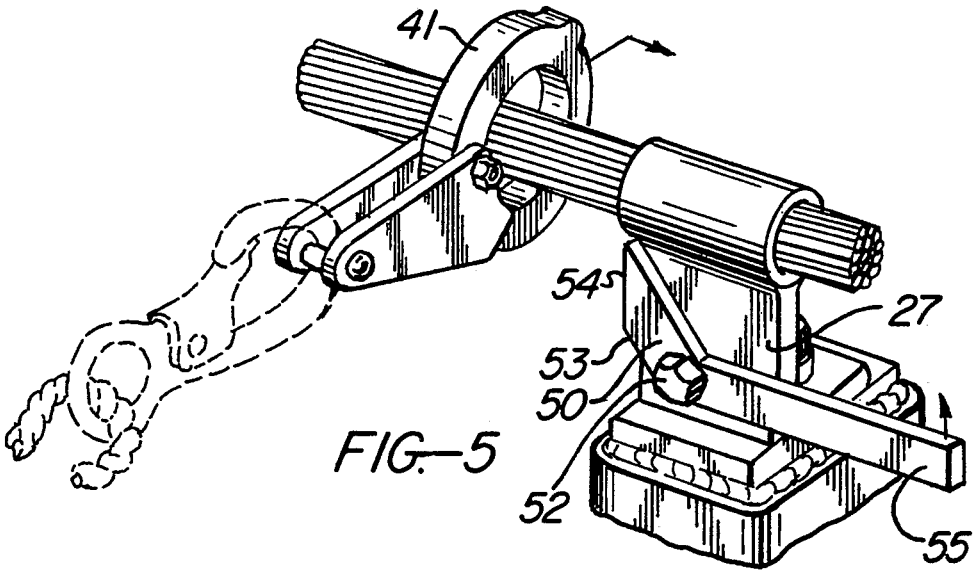
FIG. 5 is a fragmentary perspective view taken in the direction of FIG. 2, but showing an endmost cable support with retractable stop means to prevent removal of the lanyard connector from the cable.
Figure 6:
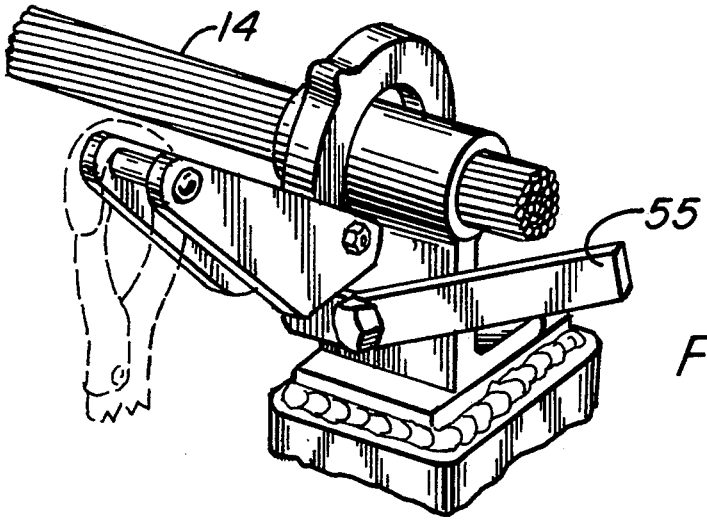
FIG. 6 is a view taken in the direction of FIG. 5, but showing the stop means in a retracted position.

FIGS. 5 and 6 show a retractable stop means on an endmost cable support for normally preventing removal of an illustrative ring element 41 from the cable system. As shown, the stop means comprises a lever 50 having a pivotal connection 52 with plate 27 of the cable support. End portion 53 of lever 50 forms a leading end 54 movable into or out of longitudinal registration with ring element 41. End portion 55 of the lever forms a handle for manual manipulation of the lever.

FIG. 5 shows the handle in a position blocking removal of ring element 41 from the cable system, end 54 of the lever obstructing passage of the ring element onto cable support plate 27. FIG. 6 shows the lever in a second position wherein the ring element 41 is able to move onto plate 27. Before the ring element can pass from the FIG. 6 position rightwardly to a position completely separated from the cable, the handle must be moved downwardly to the FIG. 5 position.

Lever 50 is so adapted that, the leading end portion 53 is acutely angled to handle 55. A two-stage motion of the fever is required in order to accomplish transition of ring element 41 onto or off of the cable system. By making it somewhat difficult to add or remove a ring element, assurance is provided that a ring element will not inadvertently be removed from the cable system during normal work operations.

The connector means (ring element 41 and tie element 35) are detachably connected to snap hook 33 of the lanyard. At the beginning or end of each work period, a worker can snap the hook 33 onto or off of tie element 35. Ordinarily, ring elements 41 and tie elements 35 will remain connected to the safety cable 14 while the cable system is in place on a building.

Thus there has been shown and described a novel workperson safety restraint system which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. A safety restraint system for a workman on a structure at an elevated location, comprising:

a plurality of cable supports spaced along said structure, each cable support comprising a support arm and a cable anchorage tube on said arm, said support arm being narrower than the tube transversely of the tube axis, a safety cable extending between and through said tubes, each tube being affixed to the cable to anchor the cable to the cable supports, said cable having a thickness greater than the transverse thickness of each support arm, a flexible lanyard having a first end attachable to a workman's body and having a free second end, connector means attached to the free end of the lanyard, said connector means comprising a ring element encircling said cable, and a tie element pivotably connected to said ring element, said ring element having two flat side faces extending transversely of the cable axis, said ring element having a radial slot of a width greater than the transverse thickness of each support arm and smaller than the thickness of the cable, whereby the ring element is slidable transversely along the cable and across the cable supports, but is not removable from the cable via the slot, said tie element being pivotably attached to the ring element for swinging motion about an axis parallel to and spaced from the cable axis, said tie element comprising a bifurcated structure having ear portions overlapping the flat side faces of said ring element, said tie element being connected to said lanyard so that upon exertion of a pulling force on the lanyard, the swing axis of the tie element is disposed on a line extending from the cable axis coincident with the lanyard line of action.

2. A safety restraint system according to claim 1, and further comprising:

a manually retractable stop means on an endmost one of the cable supports for normally preventing removal of the ring element from the system.

3. A safety restraint system for a workman on a structure at an elevated location, comprising:

a plurality of cable supports spaced along said structure, each cable support comprising a support arm and a cable anchorage tube on said arm, said support arm being narrower than the tube transversely of the tube axis, a safety cable extending between and through said tubes, each tube being affixed to the cable to anchor the cable to the cable supports, said cable having a thickness greater than the transverse thickness of each support arm, a flexible lanyard having a first end attachable to a workman's body and having a free second end, connector means attached to the free end of the lanyard, said connector means comprising a ring element encircling said cable, and a tie element pivotably connected to said ring element, said ring element having a radial slot of a width greater than the transverse thickness of each support arm and smaller than the thickness of the cable, whereby the ring element is slidable transversely along the cable and across the cable supports, but is not removable from the cable via the slot, manually retractable stop means on an endmost one of the cable supports for normally preventing removal of the ring element from the safety restraint system, said tie element being pivotably attached to the ring element for swinging motion about an axis parallel to and spaced from the cable axis, said tie element being connected to said lanyard so that upon exertion of a pulling force on the lanyard, the swing axis of the tie element is disposed on a line extending from the cable axis coincident with the lanyard line of action.

4. A safety restraint system according to claim 3, wherein:

said manually retractable stop means comprises a lever swingably mounted on the support arm of said endmost cable support.

5. A safety restraint system according to claim 4, wherein:

said lever comprises an end portion movable into or out of longitudinal registry with the ring element, and a handle actuable to move the lever between a first position wherein it blocks removal of the ring element from the system, and a second position which permits removal of the ring element from the system.

6. A safety restraint system for a workman on an elevated ledge, comprising:

a plurality of cable supports spaced along the length of the Ledge, each cable support comprising an upstanding support arm, and a cable anchorage tube on said arm, each support arm being narrower than the tube transversely of the tube axis, safety cable extending between and through the tubes, each tube being rigidly affixed to the cable, whereby the cable is anchored to each of the cable supports, said cable having a diameter greater than the transverse thickness of each support arm, a flexible lanyard having a first end attachable to a workman's body and a free second end, connector means attached to the free end of said lanyard and comprising a ring element encircling said cable, said ring element having a slot therein, said slot having a width greater than the transverse thickness of each support arm and less than the diameter of the cable, whereby the ring element can slide transversely along the cable and through the cable supports, but cannot be removed from the cable via the slot, said connector means being removable from the restraint system by sliding the ring element along the cable and over an endmost one of the cable supports, and manually retractable stop means on said endmost cable support for normally preventing removal of the ring element from the system.

7. A safety restraint system according to claim 6, wherein:

said manually retractable stop means comprises a lever swingably mounted on the upstanding arm of said endmost cable support.

8. A safety restraint system according to claim 7, wherein:

said lever has a leading end portion movable into or out of longitudinal registry with the ring element, and a handle actuable to move the lever to or from a position wherein said leading end portion blocks removal of the ring element from the system.

9. A safety restraint system according to claim 8, wherein:

the leading end portion of the lever is acutely inclined relative to the handle, such that when the ring element is at a point midway of the length of the lever the handle is required to be manually depressed in order for the ring element to pass beyond the handle.

10. A safety restraint system for a workman on a structure at an elevated location, comprising:

a plurality of cable supports spaced along said structure, each cable support comprising a support arm and a cable anchorage tube on said arm, said support arm being narrower than the tube transversely of the tube axis, a safety cable extending between and through said tubes, each tube being affixed to the cable to anchor the cable to the cable supports, said cable having a thickness greater than the transverse thickness of each support arm, a flexible lanyard having a first end attachable to a workman's body and having a free second end, connector means attached to the free end of the lanyard, said connector means comprising a ring element encircling said cable, and a tie element pivotably connected to said ring element, said ring element having a radial slot of a width greater than the transverse thickness of each support arm and smaller than the thickness of the cable, whereby the ring element is slidable transversely along the cable and across the cable supports, but is not removable from the cable via the slot, said slot being so oriented that upon exertion of a pulling force on the lanyard the slot is out of longitudinal registry with the associated support arm, whereby the workman is prevented from moving the connector means across any cable support while he is exerting pulling force on the lanyard, and said tie element being pivotably attached to the ring element for swinging motion about an axis parallel to and spaced from the cable axis, said tie element being connected to said lanyard so that upon exertion of a pulling force on the lanyard, the swing axis of the tie element is disposed on a line extending from the cable axis coincident with the lanyard line of action, said tie element comprising closure means having a blocking position extending across the ring element slot when a pulling force is exerted on the lanyard, said closure means being offset from the tie element pivot axis, whereby when there is no pulling force on the lanyard the tie element can be manually swung to a position wherein the closure means is displaced from its blocking position.

11. A safety restraint system according to claim 10, wherein:

each support arm comprises a flat plate having its major plane coincident with the axis of the associated cable anchorage tube, and said ring element having two flat side faces extending transversely of the cable axis and being spaced apart a lesser distance than the axial length of each said support arm.

* * * * *